United States Patent [19]

Thiele et al.

[11] Patent Number: 4,752,962

[45] Date of Patent: Jun. 21, 1988

[54] LOUDSPEAKER UNIT WITH MEANS FOR RELEASABLY FASTENING LOUDSPEAKER CHASSIS IS TO ITS FRAME

[75] Inventors: Karl-Heinz Thiele, Peine; Werner Stehn, Hemmingen; Günter Wirth, Isernhagen, all of Fed. Rep. of Germany

[73] Assignees: Telefunken Fernseh und Rundfunk GmbH; NEWEK Neue Elektronik-Werke GmbH, both of Hanover; Wirth Elektronik GmbH, Isernhagen, all of Fed. Rep. of Germany

[21] Appl. No.: 850,091

[22] Filed: Apr. 10, 1986

[30] Foreign Application Priority Data

Apr. 11, 1985 [DE] Fed. Rep. of Germany ..... 3512896
Sep. 27, 1985 [DE] Fed. Rep. of Germany ..... 3534521
Nov. 21, 1985 [DE] Fed. Rep. of Germany ..... 3541200

[51] Int. Cl.[4] ..... H04R 9/06; H04R 1/02; H01R 11/22

[52] U.S. Cl. ..... 381/194; 381/188; 439/832; 439/845; 439/849

[58] Field of Search ..... 179/115.5 R, 115.5 VC, 179/146 R, 146 E, 178, 179, 186; 339/258 R, 258 P; 439/830–862; 381/87, 88, 188, 205, 192, 194, 198

[56] References Cited

U.S. PATENT DOCUMENTS

| | | | |
|---|---|---|---|
| 2,611,830 | 9/1952 | Heineman | 381/189 |
| 3,012,221 | 12/1961 | Deakin | 439/830 |
| 3,646,500 | 2/1972 | Wessely | 439/381 |
| 4,203,646 | 5/1980 | Desso et al. | 439/724 |
| 4,359,133 | 11/1982 | Krolak | 181/148 |
| 4,439,643 | 3/1984 | Schweizer | 381/90 |
| 4,465,905 | 8/1984 | Nation | 381/194 |
| 4,503,292 | 3/1985 | Johnson et al. | 381/193 |
| 4,550,230 | 10/1985 | Johnson | 181/199 |
| 4,550,796 | 11/1985 | Tomita | 381/205 |
| 4,602,382 | 7/1986 | Gabbay et al. | 381/194 |

FOREIGN PATENT DOCUMENTS

| | | | |
|---|---|---|---|
| 150744 | 8/1985 | European Pat. Off. . | |
| 2739523 | 3/1978 | Fed. Rep. of Germany . | |
| 2842738 | 4/1980 | Fed. Rep. of Germany . | |
| 2834238 | 5/1980 | Fed. Rep. of Germany . | |
| 2711126 | 7/1980 | Fed. Rep. of Germany . | |
| 2935212 | 3/1981 | Fed. Rep. of Germany . | |
| 85-26635.2 | 1/1983 | Fed. Rep. of Germany . | |
| 84-0625.3 | 4/1984 | Fed. Rep. of Germany . | |
| 2527388 | 11/1983 | France | 339/258 R |

OTHER PUBLICATIONS

Grayhill Ad, *Electronic Equipment Engineering*, Jun. 1958, p. 83.

"Miniature Pluggable Contacts", *IBM Technical Disclosure Bulletin*, vol. 5, No. 5, Oct. 1962, p. 26.

*Primary Examiner*—Jin F. Ng
*Assistant Examiner*—Danita R. Byrd
*Attorney, Agent, or Firm*—Spencer & Frank

[57] ABSTRACT

Loudspeaker unit including a frame (FIG. 2) serving as sound guide to which the loudspeaker chassis (FIG. 1) is releasably fastened. According to the invention, form-locking cooperating detent means (4–6, 29–31) are provided on the frame and on the loudspeaker chassis. The loudspeaker chassis can be inserted into the frame by means of a relative translatory movement and can be removed by a rotational movement. Thus it becomes possible to install the loudspeaker in the frame and remove the loudspeaker from the frame by means of automatic machinery.

19 Claims, 7 Drawing Sheets

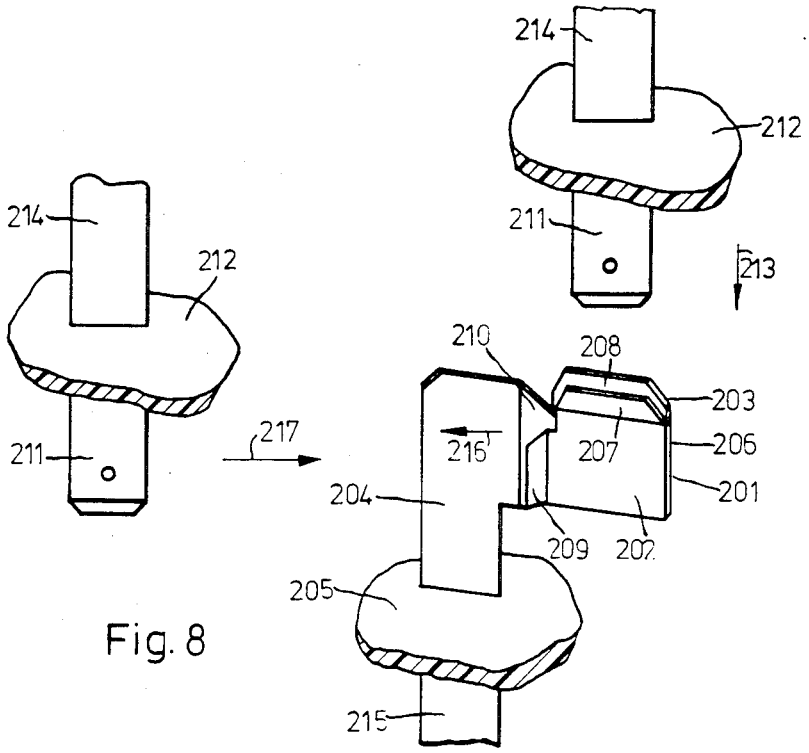
Fig. 8
Fig.9
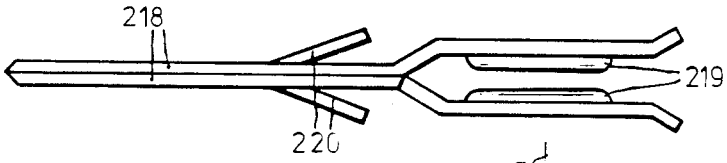
Fig.10
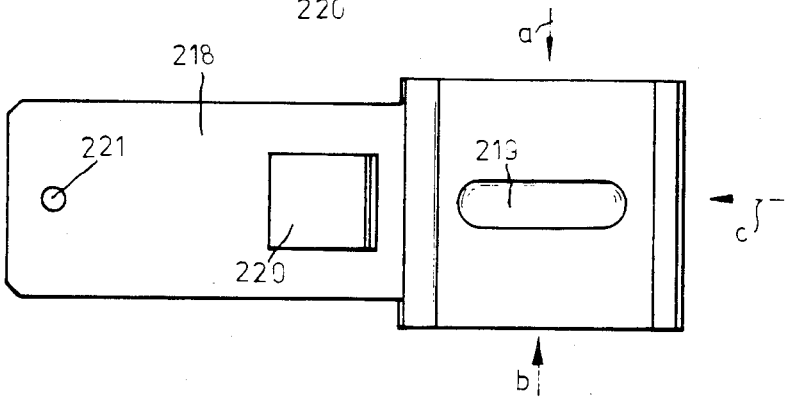
Fig.11
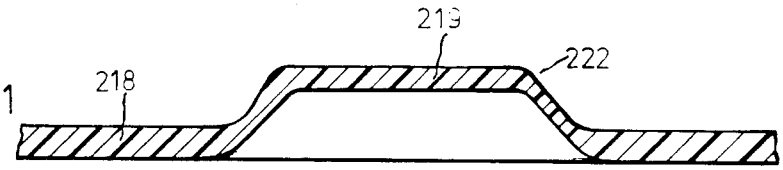

LOUDSPEAKER UNIT WITH MEANS FOR RELEASABLY FASTENING LOUDSPEAKER CHASSIS IS TO ITS FRAME

BACKGROUND OF THE INVENTION

The invention relates to a loudspeaker unit of the type including a frame, which serves a a sound guide, and a loudspeaker releasably fastened to the frame.

It is known to releasably fasten loudspeakers to a frame which serves as an acoustic baffle and is provided with a sound passage aperture. Fastening of the loudspeaker to the frame in the known arrangements is preferably effected by means of screws or clamp connections. For an exchange of loudspeakers, these connections must be released again. These ways of fastening a loudspeaker to a frame require several manual operations for fastening to as well as unfastening from the frame and can therefore not be performed without difficulty by automatic manufacturing machinery.

SUMMARY OF THE INVENTION

It is the object of the invention to provide a simplified loudspeaker unit which can be assembled with simple means suitable for automatic machinery, can be disassembled without difficulty and uses less material for housing parts.

The above object is basically achieved according to the present invention by a loudspeaker unit including a frame which serves as a sound guide and a loudspeaker chassis which is releasably fastened to the frame, wherein the releasable fastening takes place by means of cooperating form-locking detent means, which are provided respectively on the frame and on the loudspeaker chassis, for permitting insertion and fastening of the loudspeaker chassis in the frame by translatory movement only, and for permitting a rotational movement of the loudspeaker chassis relative to the frame to release the detent connection between the cooperating means for removal of the loudspeaker chassis from the frame. Advantageous features of the invention including a number of embodiments are decribed in detail below.

For the assembly of the loudspeaker chassis and the frame, a translatory movement is sufficient to join the two parts together. Disassembly for necessary repair work is likewise easily possible by performing a rotary movement and a translatory movement. In a modification of the invention, no soldering work is required for contacting electrically conductive cables during assembly or disassembly of the loudspeaker chassis and frame. Advantageously, components provided with desired break locations are inserted into the frame in such a manner that disassembly and assembly of the frame and loudspeaker chassis destroys parts of the frame and thus such disassembly and assembly can be checked at a later date.

One embodiment of the solution according to the invention permits a particularly simple structure at the loudspeaker as well as at the frame for establishing the attachment and releasability of the loudspeaker. In particular, no complicated additional components, such as, for example, fastening tongues or resilient lugs are required on the loudspeaker chassis. The resilient lugs provided on the frame, on the one hand, produce a form-locking attachment of the loudspeaker to the frame and, on the other hand, merely by rotating the loudspeaker, they permit release of the loudspeaker from the frame. The assembly of loudspeaker and frame is effected by a simple plug-in process in the axial direction of the loudspeaker without any rotation and can therefore be performed with particular ease by automatic machinery which is a particular advantage in mass production, for example, if loudspeakers are installed in the dashboard of a motor vehicle. No special measures, such as, for example, the loosening of screws, need be taken to remove the loudspeaker. It is merely necessary to rotate the loudspeaker chassis relative to the frame by a defined amount and in a defined direction. Then the loudspeaker can be removed from the frame without damage and can be replaced by a new loudspeaker in the described manner.

Preferably, contacting the supply line for the loudspeaker is effected simultaneously with plugging in of the loudspeaker. For this purpose, blade contacts are preferably provided. Two blade contacts are here provided on the loudspeaker chassis and engage in corresponding contact jaws on the frame. The contact jaws have such a configuration that the blade contacts engage in the contact jaws in the axial direction when the loudspeaker is plugged in and are able to slide out of the contact jaws in the circumferential direction, i.e. in a direction offset by 90°, when the loudspeaker is removed.

BRIEF DESCRIPTION OF THE DRAWINGS

The invention will be described below with reference to the drawings wherein:

FIG.8 shows an embodiment of the plug-in device for establishing the electrical connections in the loudspeaker unit according to the invention; and FIGS. 9 and 10 are side and plan views, respectively, of another embodiment of an electrical contact which can be used according to the invention;

FIG. 11 is a cross sectional view, to an enlarged scale, of a portion of the contact of FIGS. 9 and 10;

DETAILED DESCRIPTION OF THE PREFERRED EMBODIMENT

Figure 1A:
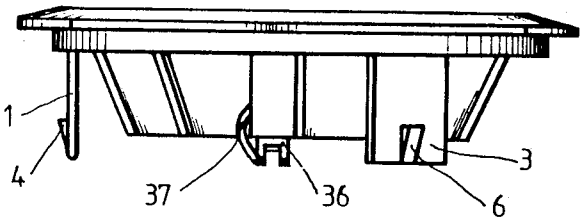
FIGS. 1A and 1B are side and rear plan views respectively of a loudspeaker chassis according to a first embodiment of the invention.
Figure 1B:
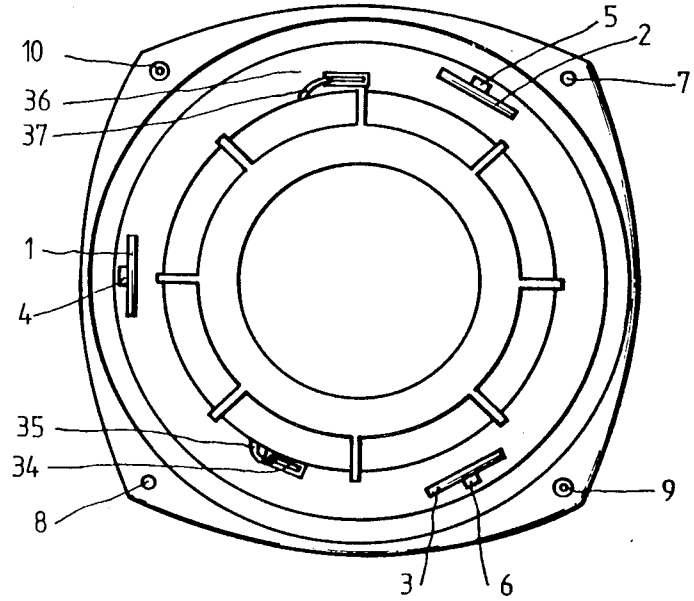

FIG. 1A is a side view of the loudspeaker chassis in which resilient locking lugs 1 and 3 equipped with barbs 4 and 6, an electrically conductive contact 36 and an electrical conductor 37 are visible. FIG. 1B shows the rear or bottom side of the loudspeaker chassis of FIG. 1A. As can be seen in this figure, loudspeaker chassis is provided with three locking lugs 1, 2 and 3 with barbs 4, 5 and 6, respectively. Projections 7, 8 and blind bores 9, 10 can be seen on the rear of the loudspeaker chassis. The electrically conductive contacts 34, 36 are connected, via respective electrical conductors 35, 37, with the coil (not shown) of the loudspeaker. When the loudspeaker chassis and the frame (FIGS. 2A and 2B) are assembled, these contacts 34, 36 automatically establish electrical contact with contacts 17, 18 provided on the frame and connected with the control circuit for the loudspeaker. In this way, the necessary electrical connection between the loudspeaker coil and the circuit controlling the loudspeaker is established automatically when the loudspeaker chassis and frame are assembled. It is not necessary to provide access to the frame from the rear.

Figure 2A:
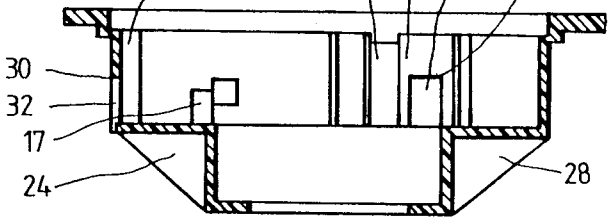
FIGS. 2A and 2B are a sectional side view and a bottom plan view respectively of a frame according to the first embodiment of the invention.
Figure 2B:
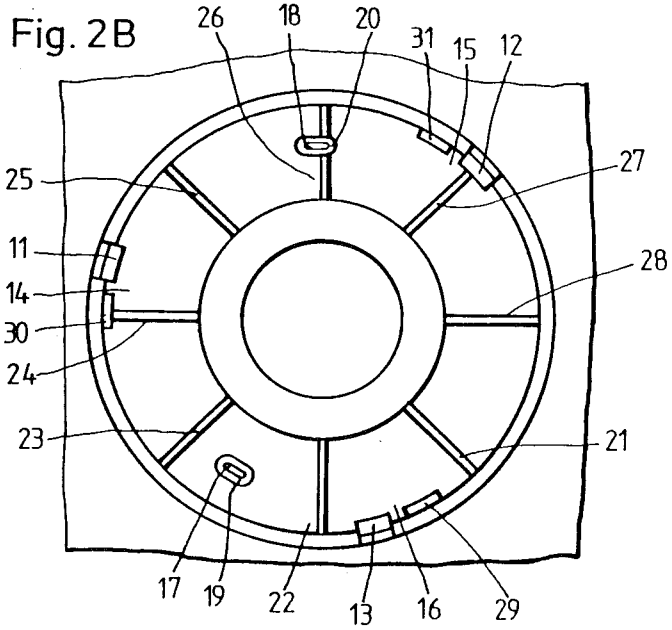

FIGS. 2A and 2B show the frame for the loudspeaker chassis of FIG. 1, including guide grooves 11 to 13, webs 14 to 16, electrical contacts 17, 18, seals 19, 20, stabilizers or ribs 21 to 28 and opening edges 29, 30, 31 for engaging the barbs 4–6. FIG. 2B shows two openings 32, 33 of the three openings which have the circumferentially extending edges 29–31 and which are normally separated from grooves 11, 13 by webs 14–16. In order to assemble the frame of FIG. 2 and the loudspeaker chassis of FIG. 1, the loudspeaker chassis is brought into such an angular position with respect to the frame that barbs 4 to 6 of the locking lugs 1 to 3 are congruent or aligned with openings 32, 33 and the third opening not visible in FIG. 2B. In this angular position, the loudspeaker chassis is pushed into the frame until barbs 4 to 6 engage in a form-locking manner behind the upper edges 29, 30, 31 of the respective openings. Thus, this assembly process requires movement of the loudspeaker chassis only in the axial direction i.e., only translatory movement, and no rotary movement. Moreover, the rear of the frame need not be accessible. This is a particular advantage if the loudspeaker chassis is set into the frame by means of automatic machinery and the rear of the frame is difficult to access, e.g. if the frame is part of a larger housing or part of the dashboard of a motor vehicle. Thus, webs 14 to 16 and grooves 11 to 13 play no part in the assembly process.

For disassembly of the loudspeaker chassis and frame, the loudspeaker chassis is rotated in the direction that causes barbs 4 to 6 to act on webs 14 to 16. Webs 14 to 16 are given such weak dimensions that they break during this rotation process so that barbs 4 to 6 on lugs 1 to 3 are able to enter grooves 11 to 13. Grooves 11 to 13 are open toward the front of the frame, i.e. toward the bottom in FIG. 2B. Thus, the loudspeaker chassis can be removed from the frame in that barbs 4 to 6 slide along grooves 11 to 13. Webs 14 to 16 which are provided as desired break locations serve the purpose of indicating, when the loudspeaker is being serviced, that the loudspeaker chassis has already been disassembled once. Thus, even for the disassembly of loudspeaker chassis and frame, no access to the rear of the frame is required, which is advantageous for the reasons mentioned above.

Figure 3:
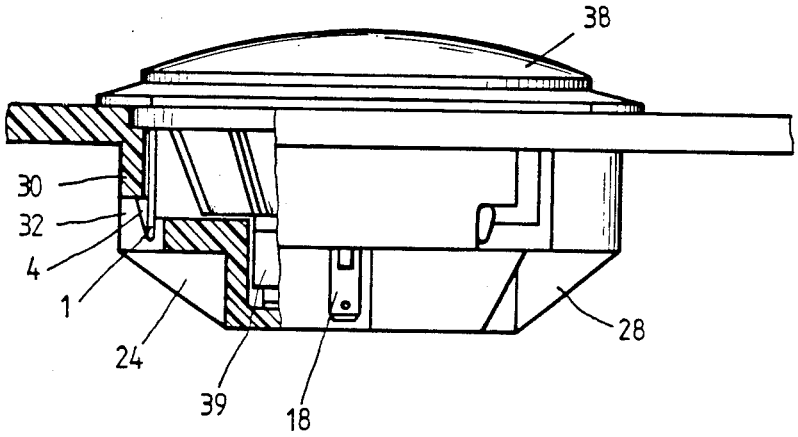
FIG. 3 is a side view, partially in section of the loudspeaker chassis of FIG. 1 and the frame of FIG. 2 in the assembled state.

FIG. 3 shows the loudspeaker chassis and frame in the assembled state. Visible are the locking lug 1 and its barb 4, which is form-lockingly engaged behind edge 30 of opening 32, a protective grille 38 and a loudspeaker magnet 39.

Figure 4:
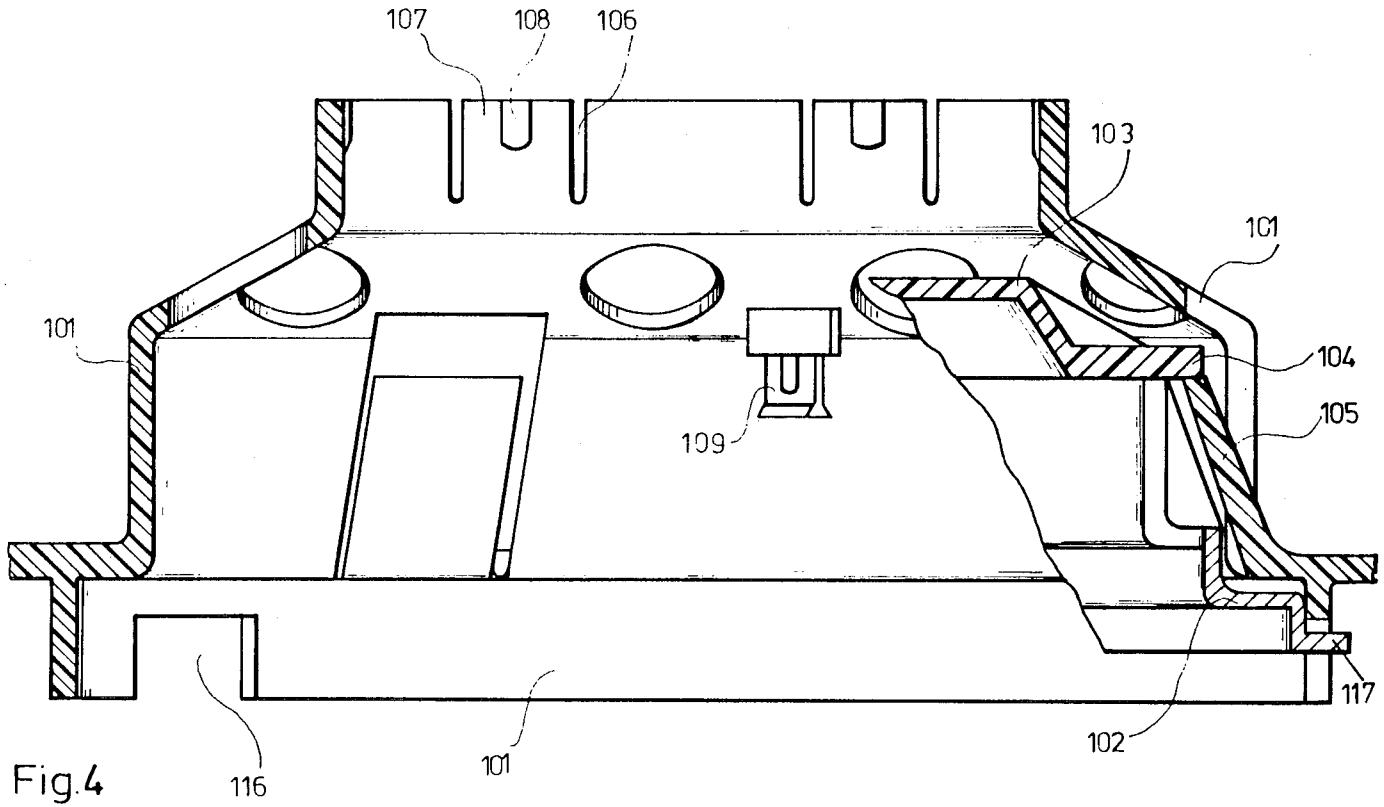
Figure 5:
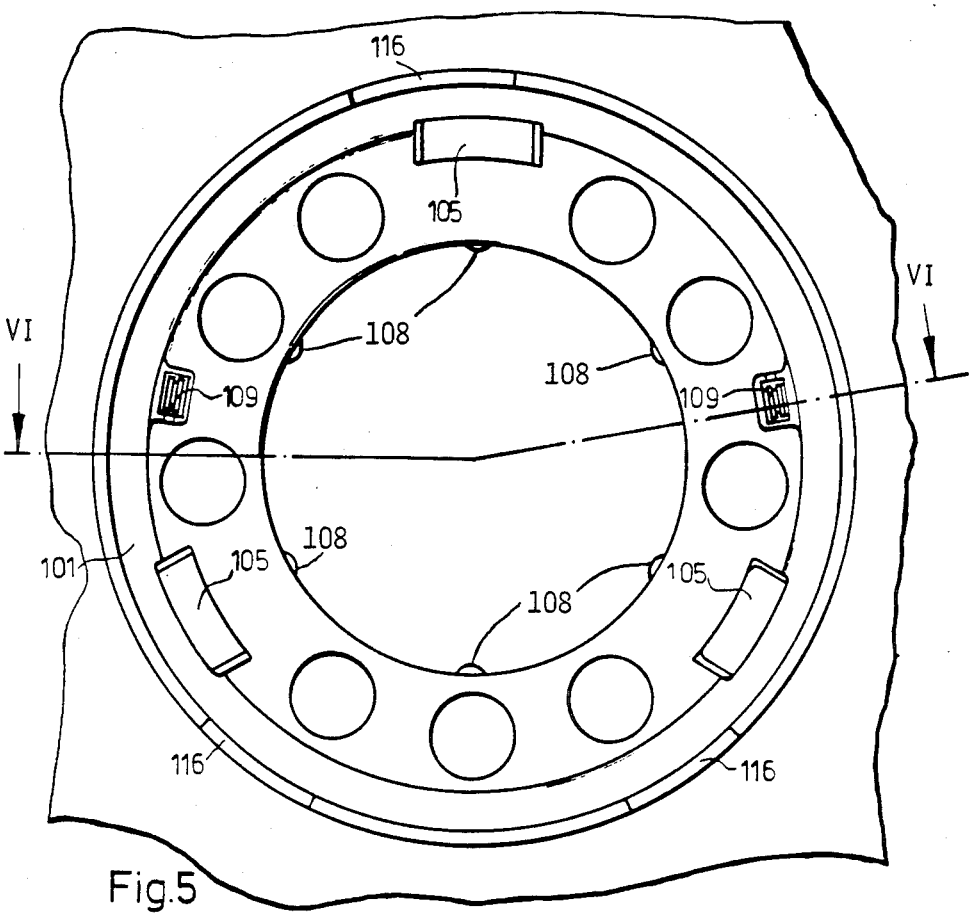
Figure 6:
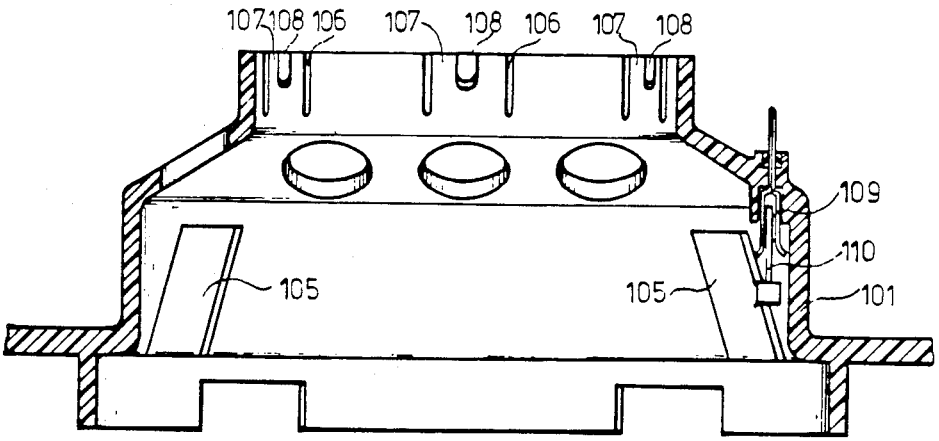

Referring now to FIGS. 4–6, FIG. 4 is a partial sectional view of a section of, for example, an automobile dashboard made of plastic. A frame 101 is shaped to be part of the dashboard and serves, inter alia, to accommodate a circular loudspeaker 102. The outer contours of frame 101 are approximately matched to the shape of loudspeaker 102. Frame 101 is equipped with lugs 105 which project obliquely into the free space of frame 101. These lugs 105 are part of a snap-in attachment for loudspeaker 102 which is provided with laterally extending projections 104 on its chassis 103. When loudspeaker 102 is inserted, these projections 104 slide along lugs 105 and, in the final position of loudspeaker 102, engage behind lugs 105 in that lugs 105 return to their rest position.

As guidance for the loudspeaker during the insertion process and also to hold it in the mounted state, guide segments 107 adapted to the loudspeaker magnet are provided in the rear portion of frame 101 and are elastically deformable by means of slits 106. Ribs 108 are provided on guide segments 107 so as to place themselves closely against the loudspeaker magnet during the insertion process.

Blade contacts 110 (FIG. 6) are provided as electrical contact terminals on the loudspeaker chassis 103 and engage in contact jaws 109 on the frame 101 already during the insertion process. This makes it possible to test the loudspeaker for proper operation already during installation to assure in this manner that loudspeaker 102 is mounted in its intended position.

The number of projections 104 on the loudspeaker chassis 103 corresponds to the number of lugs 105 provided in frame 101. The width of projections 104 is selected so that, if loudspeaker 102 is rotated about a certain angle of about 15° to 30°, projections 104 are rotated beyond lugs 105 and come to lie next to the sides of the lugs 105 so that the loudspeaker can be taken out of the frame. Contact jaws 109 have such a configuration that blade contacts 110 remain in engagement during the rotating process.

Three recesses 116 are provided on the outer edge of frame 101 and corresponding lateral projections 117 are provided on the loudspeaker 102. When loudspeaker 102 is inserted into frame 101, projections 117 engage in recesses 116. This arrangement serves the purpose of permitting loudspeaker 102 to be inserted into frame 101 only in a defined position in which the described contacts 109, 110 come into engagement. For this purpose, recesses 116 and projections 117 are distributed irregularly about the circumference so that loudspeaker 102 can be inserted only in one position. The width of projections 117 is here smaller than the width of recesses 116 to permit loudspeaker 102 when disposed in frame 101 to be rotated in the described manner for removal. It is also possible to provide recesses 116 on the loudspeaker and projections 117 on the frame.

FIG. 5 is a top view of the opening in frame 101. Three lugs 105 and two contact jaws 109 can be seen. During the insertion process, the loudspeaker magnet is centered by means of resilient ribs 108 and, when the installation is completed, these ribs protect the magnet against shocks.

FIG. 6 is a partial sectional view in the direction shown in FIG. 5 and additionally showing the electrical contacting of the installed loudspeaker 102. Blade contact 110 disposed on loudspeaker 102 has been added in the drawing and inserted into the contact jaws 109 connected with frame 101.

Figure 7:
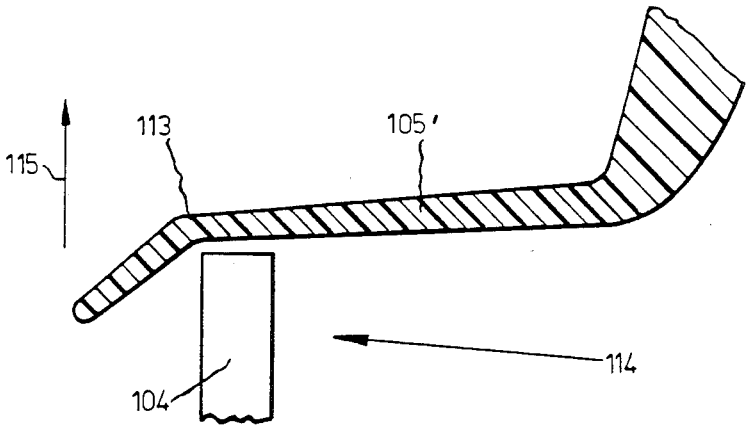
FIGS. 4–7, are various views showing a loudspeaker chassis and frame according to another embodiment of the invention.

FIG. 7 shows a special configuration or modification of the lug 105 of the embodiment of FIGS. 4–6. As shown in FIG. 7, at a bending location 113, lug 105' is angled inwardly, i.e. toward the axis of frame 101 and of inserted loudspeaker 102. Thus lug 105' is in such a position that, when the loudspeaker with its chassis is inserted in the direction marked 114, projection 104 causes lug 105' to be deflected in the radial direction only after it reaches bending location 113. If insertion is manual, the point at which projection 104 hits bending location 113 can be detected to once more check, for example, the precise position of the loudspeaker. Lug 105' and contacts 109, 110 are arranged in such a manner that contacts 109, 110 are already in engagement when projection 104 reaches bending location 113 and the operation of the loudspeaker can be checked. Then, projection 104 is moved further in direction 114 with increased force until the end of lug 105' engages behind the right edge of projection 104 in the described manner.

As shown in FIG. 8, contact jaws 201 are composed of two parallel spaced planar contact springs 202, 203 and an essentially rigid or slightly resilient member 204 which is fixed in frame 205, e.g. in the dashboard of a motor vehicle. Members 202, 203, 204 form a single component, with component 202 being formed by bending at location 206. Components 202, 203 include respective outwardly angled ends 207, 208 at their top sides and further outwardly angled respective ends 209, 210 at their right sides. Ends 207, 208 and 209,210, respectively, which form a conical opening, permit secure insertion of blade contact 211 which is fixed in component 212, i.e. the chassis of a loudspeaker. At its front end, blade contact 211 is chamfered. Blade contact 211 can be inserted from the top into contact jaws 201 in direction 213. The upper end 214 of contact 211 is connected, for example, with the moving coil of a loudspeaker and the lower end 215 of component 204 is connected with the output of an LF amplifier. Rotation of the component containing blade contact 211, e.g. a loudspeaker, permits blade contact 211 to slide back out of contact jaws 201. Likewise, blade contact 211 shown on the left can be inserted into contact jaws 201 in direction 217 while being guided by the ends 209, 210.

FIGS. 9, 10 show a further embodiment of a contact which can be used including two identical contact springs 218 which face one another in a mirror image arrangement and form contact jaws corresponding to jaws 201 according to FIG. 8. The contact faces are formed by raised portions 219 which are pressed out of the material of the contact springs by deep drawing. Two such raised portions 219 of the two mirror image arranged contact springs 218 face one another and form between them the contact jaws. The pressed-out tongues 220 serve to hold contact springs 218 in a frame, e.g. the dashboard of a motor vehicle. Bores 221 serve to fasten a connecting wire for the established contact jaws. FIG. 10 is a top view of only the lower contact spring 218.

FIG. 11 is a sectional view of a contact spring 218 in the region of raised portion 219. The transitional rounding 222 at the upper circumferential edge of raised portion 219 is constant along the circumference of raised portion 219 so that the blade contact can be inserted equally properly into the established contact jaws in directions a, b, and c and also in the direction between a and c and between c and b as shown in FIG. 10. When raised portion 219 is produced in a deep drawing process, the material of contact spring 218 is not interrupted anywhere. As indicated in the drawing, the thickness of the material is merely reduced somewhat in the region of raised portion 219.

Figure 12:
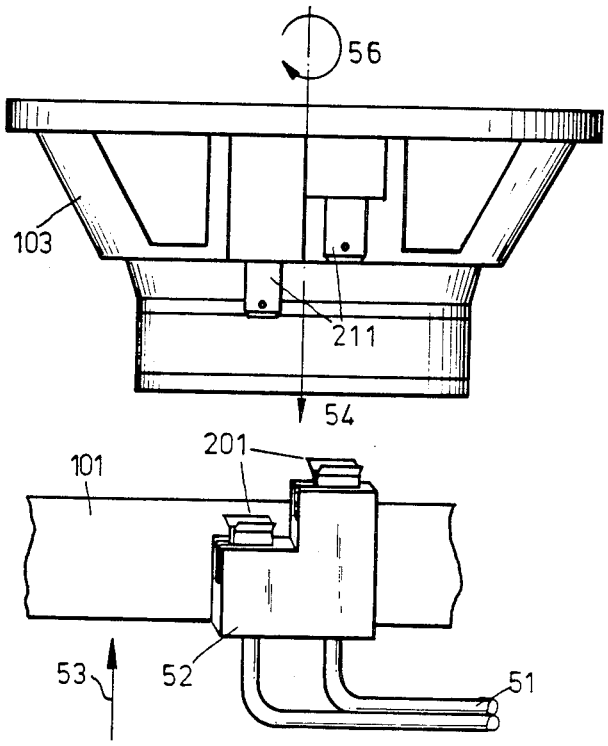
FIG. 12 and FIGS. 13 and 14 show respective further embodiments and arrangements of the plug-in device for establishing the electrical connections.

In FIG. 12, chassis 103 is provided with two blade contacts 211 which are disposed on the same radius, i.e. on one circumference of loudspeaker chassis 103. On this circumference, blade contacts 211 are offset with respect to one another in the circumferential direction and have different lengths. Together with connecting lines 51, the associated contact jaws 201 are embedded in contact carrier 52 which is inserted into frame 101 in direction 53 in a detent connection, a so-called snap-in connection. Thus, contact jaws 201 are not fixedly disposed in frame 101, but within the insertable and removable carrier 52. When the loudspeaker is installed in frame 101 in direction 54, blade contacts 211 engage in contact jaws 201. For removal, chassis 103, is moved in direction 56, i.e. rotated about its axis, so that the lock between chassis 103 and frame 101, as described for example with respect to FIGS. 1–6, is released, and blade contacts 211 slide to the left out of the side of contact jaws 201. Lines 51, component 52 and contact jaws 201 are preferably a vulcanized or plastic clad unit.

Figure 13:
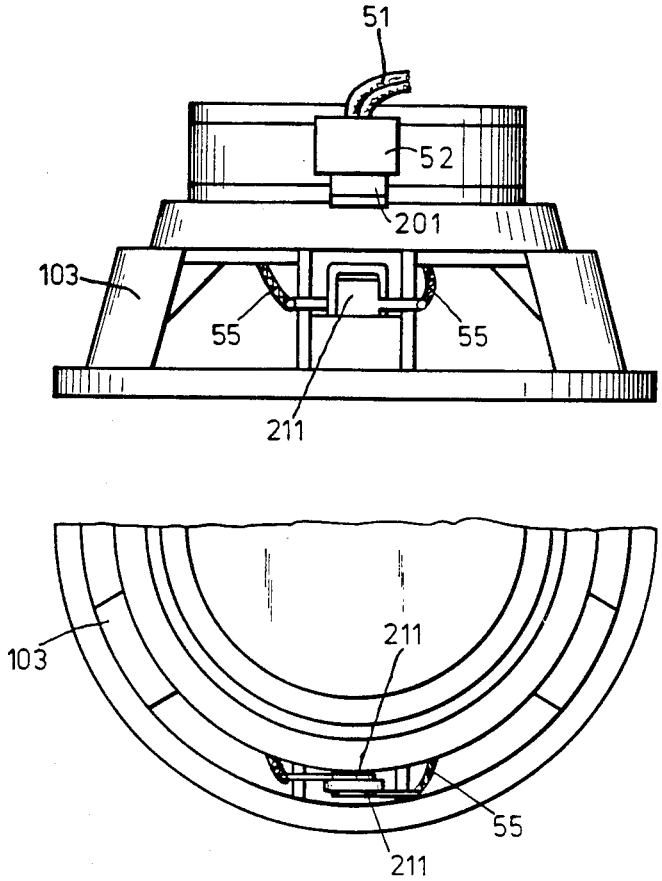
Figure 14:
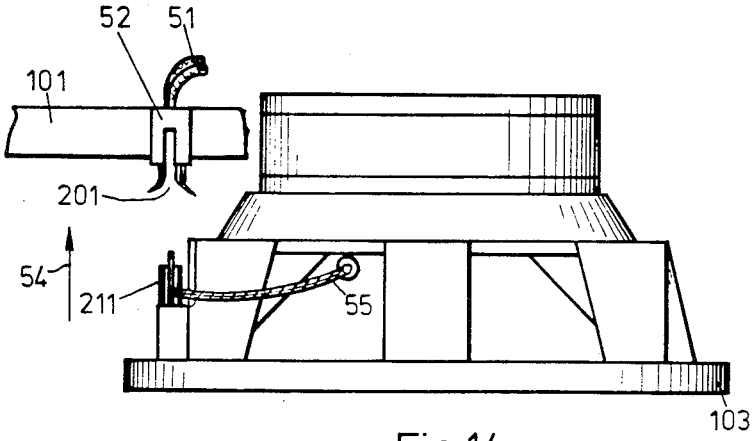

In FIGS. 13, 14, blade contacts 211 and, correspondingly, contact jaws 201 are mutually offset in the radial direction, i.e. lie on different sized radii, but in the same angular position relative to the circumference. This solution has the advantage that, in contradistinction to FIG. 12, blade contacts 211 and contact jaws 201 may have the same length. Contact jaws 201 are again disposed in a component 52 which, as in FIG. 12, is inserted into frame 101 by means of a detent connection.

Connection lines 55 in FIGS. 13, 14 between the diaphragm and blade contacts 211 are brought to blade contacts 211 from different sides and are connected with soldering lugs provided there. This has the advantage that the danger of contact with generally uninsulated lines 55 is reduced. If blade contacts 211 and contact jaws 201 according to FIG. 12 are disposed on the circumference of the chassis, i.e. at the same radial distance from the axis, it is advisable to select the spacing between contacts in the circumferential direction large enough that during rotational movement one blade contact 211 is unable to simultaneously contact two contact jaws 201 since such contact would produce a short circuit of the input leads and raise the danger of the supplying amplifier being destroyed. In this solution, the contacts need not have different lengths, as in FIG. 12, but may each be of identical length.

We claim:

1. In a loudspeaker unit including a frame which serves as a sound guide, a loudspeaker chassis, and means for releasably fastening said loudspeaker chassis in said frame; the improvement wherein: said means for releasably fastening includes first and second cooperating form locking detent means, disposed respectively on said loudspeaker chassis and on said frame, for fastening said chassis to said frame via a detent connection in response to translatory motion only of said chassis relative to a frontal surface of said frame, and for releasing said detent connection upon relative rotation between said chassis and said frame to permit removal of said chassis from said frame; said first form locking detent means includes a plurality of resilient locking lugs equipped with respective barbs provided on said loudspeaker chassis; and said second form locking detent means includes a like plurality of openings provided in said frame and having circumferentially extending edges for receiving the barbs in a form locking manner, and a like plurality of axially extending guide grooves which are provided in said frame circumferentially adjacent the respective said openings and which are open toward the frontal surface of the frame, whereby the barbs, after being rotated as a result of said relative rotation between said chassis and said frame, can slide through said grooves so as to permit separation of the chassis from the frame.

2. A loudspeaker unit according to claim 1, wherein breakable webs are provided on the frame between the respective adjacent said openings and guide grooves to serve as desired break locations, with said webs being breakable by said barbs upon said relative rotation to permit said barbs to enter said guide grooves.

3. A loudspeaker unit according to claim 1, wherein: the loudspeaker chassis is provided with first electrically conductive contacts which, by means of electrical conductors, are connected with the loudspeaker moving coil; the frame is provided with second electrically conductive contacts which establish electrically conductive connections with a device generating an audio signal; and, during assembly, the first electrically conductive contacts are pushed into the second electrically conductive contacts.

4. In a loudspeaker unit including a frame which serves as a sound guide, a loudspeaker chassis, and means for releasably fastening said loudspeaker chassis in said frame; the improvement wherein: said means for releasably fastening includes first and second cooperating form locking detent means, disposed respectively on said loudspeaker chassis and on said frame, for fastening said chassis to said frame via a detent connection in response to translatory motion only of said chassis relative to a frontal surface of said frame, and for releasing said detent connection upon relative rotation between said chassis and said frame to permit removal of said chassis from said frame; said second form locking detent means includes a plurality of resilient lugs which project from the frontal surface of the frame inwardly into a region of the frame into which the loudspeaker chassis is inserted and which can be outwardly deflected; said first form locking detent means includes a like plurality of laterally extending projections which are disposed on the chassis, which engage and outwardly deflect said lugs during the insertion of the chassis into said frame and which, in the inserted state, are held behind the lugs; and the release of the loudspeaker chassis from the frame is effected by rotating the chassis in a desired direction relative to the frame such that the projections are adjacent, and not behind, the lugs.

5. A loudspeaker unit according to claim 4, wherein first electrical contacts for the loudspeaker are arranged on the frame such that, when the loudspeaker chassis is inserted into the frame, said first electrical contacts automatically come into engagement with corresponding second electrical contacts on the chassis.

6. A loudspeaker unit according to claim 5, wherein the second contacts are blade contacts, and the first contacts are respective contact jaws, each shaped so as to tightly hold a respective one of the second contacts.

7. A loudspeaker unit according to claim 5, wherein the first contacts are open toward the frontal surface of the frame and in the direction of rotation of the chassis.

8. A loudspeaker unit according to claim 6, wherein: the contact jaws are configured such that the blade contact can be inserted into the contact jaws in several directions and can be rotated out of said contact jaws.

9. A loudspeaker unit according to claim 8, wherein two parallel contact springs, which form the contact jaws, are each provided, at two mutually perpendicular edges, with obliquely outwardly angled ends.

10. A loudspeaker unit according to claim 6, wherein said blade contacts are disposed on the loudspeaker chassis and said contact jaws are disposed on the frame, with all of said blade contacts and said contact jaws having the same radial spacing from the axis of said loudspeaker unit.

11. A loudspeaker unit according to claim 10, wherein the respective blade contacts have different lengths and the respective contact jaws have different lengths.

12. A loudspeaker unit according to claim 10, wherein the contact jaws are circumferentially spaced on the frame at large enough distances that, during the rotational movement, one blade contact is unable to simultaneously touch two contact jaws.

13. A loudspeaker unit according to claim 6, wherein the blade contacts and their contact jaws are arranged to be radially offset with respect to one another along the same radius relative to the axis.

14. A loudspeaker unit according to claim 6, wherein the contact jaws are disposed in a contact carrier which is mounted on the frame by means of a detent connection.

15. A loudspeaker unit according to claim 14, wherein the contact jaws and electrical connecting lines connected to said jaws, together with the contact carrier, form a vulcanized or plastic clad unit.

16. A loudspeaker unit according to claim 6, wherein two connecting lines extend from the loudspeaker diaphragm to two blade contacts from different sides and are connected with the two blade contacts.

17. A loudspeaker unit according to claim 4 wherein: the lugs initially extend rearwardly from the frontal surface of the frame toward the rear surface of the frame and then are angled inwardly toward the axis of the frame at a bending location; and said projections are dimentional to initially engage said lugs at said bending location during insertion of said chassis into said frame.

18. A loudspeaker unit according to claim 4 wherein recesses are provided on the frame and projections are provided on the loudspeaker chassis at positions to engage in the respective recesses to align the loudspeaker chassis relative to the frame.

19. In a loudspeaker unit including a frame which serves as a sound guide, a loudspeaker chassis, and means for releasably fastening said loudspeaker chassis in said frame; the improvement wherein: said means for releasably fastening includes first and second cooperating form locking detent means, disposed respectively on said loudspeaker chassis and on said frame, for fastening said chassis to said frame via a detent connection in response to translatory motion only of said chassis relative to a frontal surface of said frame, and for releasing said detent connection upon relative rotation between said chassis and said frame to permit removal of said chassis from said frame; said frame includes a sleeve-shaped member for receiving loudspeaker magnets; and said sleeve shaped member is provided with axially oriented slits for forming guide segments which yield in the radial direction.

* * * * *